US005927395A

United States Patent [19]

Damiani

[11] Patent Number: 5,927,395

[45] Date of Patent: Jul. 27, 1999

[54] PLATE-TYPE HEAT EXCHANGER

[75] Inventor: Alfredo Damiani, Verona, Italy

[73] Assignee: Cipriani Scambiatori S.R.I., Verona, Italy

[21] Appl. No.: 09/089,623

[22] Filed: Jun. 3, 1998

[30] Foreign Application Priority Data

Apr. 23, 1998 [IT] Italy ..... VR98A028

[51] Int. Cl.[6] ..... F28F 3/10

[52] U.S. Cl. ..... 165/166; 165/167; 165/DIG. 369

[58] Field of Search ..... 165/166, 167

[56] References Cited

U.S. PATENT DOCUMENTS

| | | | |
|---|---|---|---|
| 4,377,204 | 3/1983 | Johansson | 165/166 |
| 4,556,106 | 12/1985 | Evans | 165/166 |
| 4,635,715 | 1/1987 | Andersson | 165/167 |
| 4,905,758 | 3/1990 | Mathur et al. . | |
| 5,727,620 | 3/1998 | Schaufele | 165/166 |

FOREIGN PATENT DOCUMENTS

| | | | |
|---|---|---|---|
| 1726965 | 4/1992 | U.S.S.R. | 165/167 |
| 493490 | 10/1938 | United Kingdom . | |
| 2141814 | 1/1985 | United Kingdom . | |
| 2028996 | 3/1990 | United Kingdom . | |
| 01189 | 2/1987 | WIPO . | |

*Primary Examiner*—Leonard Leo
*Attorney, Agent, or Firm*—Merchant, Gould, Smith, Edell, Welter & schmidt

[57] ABSTRACT

A plate-type heat exchanger is provided with a sealing device positioned between pairs of adjacent plates (12). Said device comprises a gasket (11) placed inside of a suitable peripheral groove (21), as well as a plurality of protuberances (10) projecting from a peripheral area (13) of said gasket (11) towards a peripheral area of the plate (12) to which said device is coupled. Said heat exchanger is provided with a plurality of recesses (19) having a predetermined shape and placed along the peripheral edge of each plate (12) constituting said heat exchanger; furthermore, each protuberance (10) has a shape which is conjugated to the shape of the corresponding recess (19) so that said protuberance (10) can interact with said corresponding recess (19) in such a way as to insert an edge of said recess (19) inside of a groove (16) provided in each protuberance (10).

17 Claims, 2 Drawing Sheets

PLATE-TYPE HEAT EXCHANGER

TECHNICAL FIELD

The present invention relates to a plate-type heat exchanger provided with a sealing device which can be easily and quickly positioned or removed when it has to be replaced.

The invention may be mainly applied in the field of thermo-mechanical industry.

BACKGROUND ART

Plate-type heat exchanger devices are well known in the art.

These devices are constituted by a fixed and a movable endplate, one or both being provided, according to different applications, with inlet and outlet connections for fluids, a pack of metallic plates, generally stainless steel plates, being disposed between said endplates.

Said metallic plates, which are bored close to their angled edges in order to allow the circulation of the fluids, constitute the surface of thermal exchange between the fluids and are provided with a series of ribs suitable to increase the exchange surface and the fluid turbulence in order to obtain relevant thermal exchanges.

Generally, said ribs are disposed according to a herring-bone or a so-called laundress-board pattern.

Furthermore, the periphery of such plates is provided with sealing gaskets made of an elastic, rubber-like material, which delimit and physically separate the pair of channels formed inside of the heat exchanger and within which the fluids flow.

This type of device is generally used in applications of various kinds, e.g. for instantaneously producing sanitary hot water by means of a boiler, with or without buffers, or for the heating exploiting geothermal gradients, or for swimming-pool heating by means of a boiler, or for a district-heating network.

Obviously, in accordance with particular applications, said devices are differently dimensioned in what concerns the surface and the number of plates, as well as the different feeding circuits, in series or in parallel, to be used to convey the fluids to the plates.

As regards to the sealing gaskets, which are placed peripherally to said plates, they play a determinant role in the operation of plate-type heat exchangers.

In fact, said gaskets have to be made of high quality materials allowing the gaskets to carry out a perfect seal at high temperatures and pressures, as well as to hold their efficiency even after thousands of hours of operation.

Furthermore, they should perfectly match to suitable grooves the plates of heat exchangers are provided with, said grooves, on their turn, allowing the gaskets to be placed against possibly vertical walls in order to obtain a good support against the thrust which is exerted on the gasket from the inner side of the exchanger and this, particularly, in proximity of the fluid inlet bores.

The background art proposes different solutions in order to allow the gaskets to be correctly placed inside of the grooves present in the plates of plate-type heat exchangers.

A first known solution provides for the use of a suitable glue in order to stick the gasket on the groove's bottom.

However, this solution involves a plurality of disadvantages and drawbacks which are due to the complex maintenance of the plates and/or to the complex replacement of the gaskets, as well as very high material and labour costs.

In fact, a sticked gasket should be replaced by eliminating the old bonding agent by means of a suitable solvent; this operation should be carried out with care, in order to avoid damaging of the plate.

Thereafter, the groove should be carefully cleaned, and a new glue layer is placed in the same; then, a new gasket is placed into the groove and it is necessary to wait till it perfectly adheres to its seat.

Of course, this involves remarkable loss of time due to the carrying out of all the above cited operations and, in particular, of the sticking operation.

In the field of bolding agents, Italian Patent n. 1.257.033 discloses the use of an acrylic adhesive layer the chemical-physical features of which are suitable for fixing the sealing gaskets to the plates of plate-type heat exchangers.

In fact, since said acrylic adhesive is particularly sensitive to pressure and is also provided with high setting velocity, it allows the gasket to be immediately placed on the plate, just after the acrylic adhesive has been spread.

Furthermore, the acrylic adhesive according to said technical solution allows the coupled elements to be removed and connected again, without decreasing the glueing activity and without leaving adhesive traces on the gasket and on the plate allowing the easy replacement of the gasket if necessary.

Another solution well known to the skilled man is disclosed in European Patent Application EP-A-0 039 229, where no mention is made of bonding agents.

According to said document the periphery of the gasket is provided with a series of substantially cylindrical protuberances which are suitable for being housed, by exerting a pressure on them, into corresponding holes which are present along the external periphery of said plate.

However, this solution involves drawbacks too, since it requires, for example, a very high precision for positioning the gasket relative to the plate in such a way as each protuberance is aligned to the corresponding plate hole.

Furthermore, it is apparent that such a technical solution requires specific plates provided with suitables holes for the connection of the gasket to the plate; thus, said modified plates can not be universally used.

Document WO 85/00052 shows a further technical solution for coupling a sealing gasket to a plate of a plate-type heat exchanger.

According to said document, the sealing gasket is provided with a series of tabs which are made of the same rubber material as the gasket and which are formed on the external periphery of the gasket.

In operation, these tabs are inserted into cavities which are formed between the upper and lower surfaces of the plate, and they allow a sufficiently quick positioning of the gasket into the groove.

However, this solution involves drawbacks too, since the gasket is positioned in a rather rough way relative to the groove.

Furthermore, since the fastening tabs are necessarily made of rubber, they cannot show a high strength against thermal and mechanical stresses which a gasket normally undergoes during its working life.

As a result, the gasket gets frequently out of the groove, thereby causing leakages in the heat exchanger.

DESCRIPTION OF THE INVENTION

The present invention aims to obviate the disadvantages and drawbacks which are typical of the background art, and thus to provide for a plate-type heat exchanger provided with a sealing device which can be easily placed and removed and which can assure an excellent sealing while operating the heat exchanger.

This is achieved by means of the features disclosed in the main claim.

The dependent claims outline particularly advantageous forms of embodiment of the present invention.

The plate-type heat exchanger according to the present invention is provided with a suitable sealing gasket comprising a plurality of protuberances arranged along the outer and/or inner periphery of said gasket, particularly in correspondence of the peripheral zone of the plate to which said gasket is coupled.

Said protuberances have a predetermined suitable shape and are made of the same material as the sealing gasket since they are obtained, together with the gasket, by means of a common molding operation.

According to a particularly advantageous form of embodiment of the present invention, said protuberances show a first rectangularly shaped portion which is coupled to a second portion having a substantially discoidal shape.

According to said form of embodiment, the first portion, which is remarkably thinner than the gasket, is preferably placed perpendicular to the outer peripheral edge of the gasket.

Furthermore, said first portion connects the second portion to the peripheral edge of the gasket when positioned inside of its seat, as previously disclosed with reference to the mentioned background art.

Moreover, said second portion of the protuberance is remarkably thicker than the first portion and its thickness is comparable to, and sometimes identical to, the thickness of the sealing gasket.

According to the present invention, the second portion of the sealing gasket is provided with a groove obtained within said second portion; according to the form of embodiment mentioned above said groove divides said second portion into two identical discs superimposed to each other.

Besides, each plate of the heat exchanger according to the present invention is provided with a plurality of recesses arranged in correspondence of the peripheral zone of said plates, said recesses having a suitable shape in order to receive, in operation, the protuberances of the sealing gasket.

According to the form of embodiment mentioned above, said recesses have a substantially discoidal shape.

Thus, when the gasket is placed on the plate, the skilled man has only to position the sealing gasket inside of its seat in the peripheral zone of the plate and to fix said gasket by coupling the groove of the second portion of the protuberance to the corresponding recess of the plate.

In such a way, the edge of the recess is introduced by pressure inside of the groove which is resent in the second portion of each protuberance.

More particularly, while the plate recess interacts with said groove, the two discoidal portions of the second portion respectively interact with the upper and the lower surfaces of the plate in proximity of the recess.

According to a further particular form of embodiment of the present invention, each protuberance of the sealing gasket is provided with a suitable strenghtening rib which is present in the first portion and partially in the second portion of said protuberance.

In fact, since said strengthening rib is positioned longitudinally to the first portion, i.e. substantially perpendicular to the plate edge, it has the purpose of conferring rigidity and strength to the first portion of the gasket, said first portion being the thinnest one and then the one which is most mechanically and thermally stressed while operating the heat exchanger.

Thus, the plate-type heat exchanger according to the present invention allows a simple and effective positioning of the sealing gasket which can be easily and quickly placed in, or removed from, its seat without using any glues or any further additional sealing elements.

Furthermore, the present invention assures an effective and safe seal even in proximity of the fluids inlets which are the most critical points for correctly operating the heat exchanger.

ILLUSTRATION OF DRAWINGS

Other features and advantages of the present invention will become apparent by reading the following description of a form of embodiment of the invention, given as a non-limiting example, with the help of the figures illustrated in the attached drawings, in which.

DESCRIPTION OF A FORM OF EMBODIMENT

Figure 1:
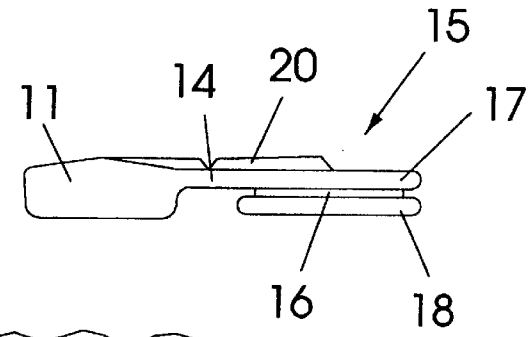
FIG. 1 shows a schematical side sectional view of a sealing gasket protuberance of a plate-type heat exchanger according to the present invention.
Figure 2:
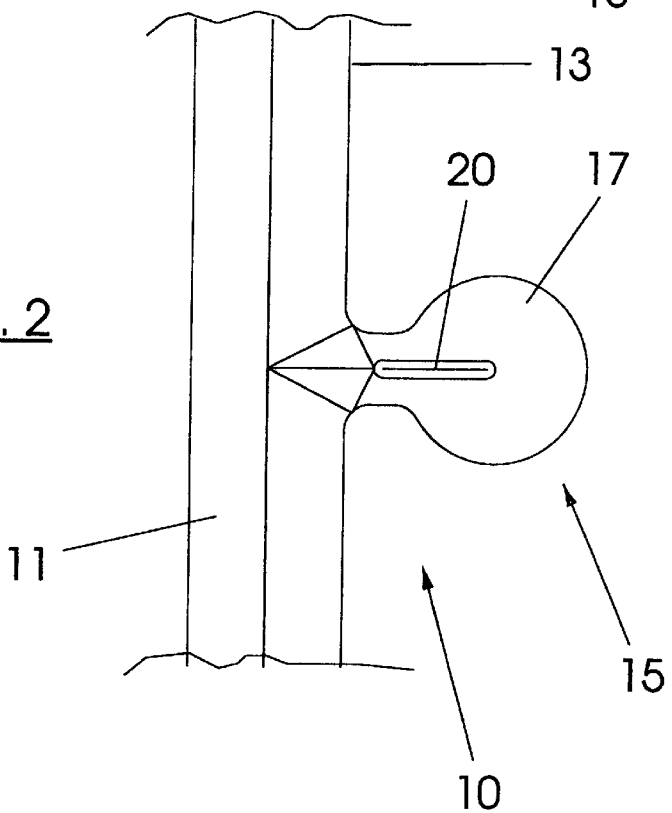
FIG. 2 shows a plan view of the protuberance of FIG. 1.
Figure 3:
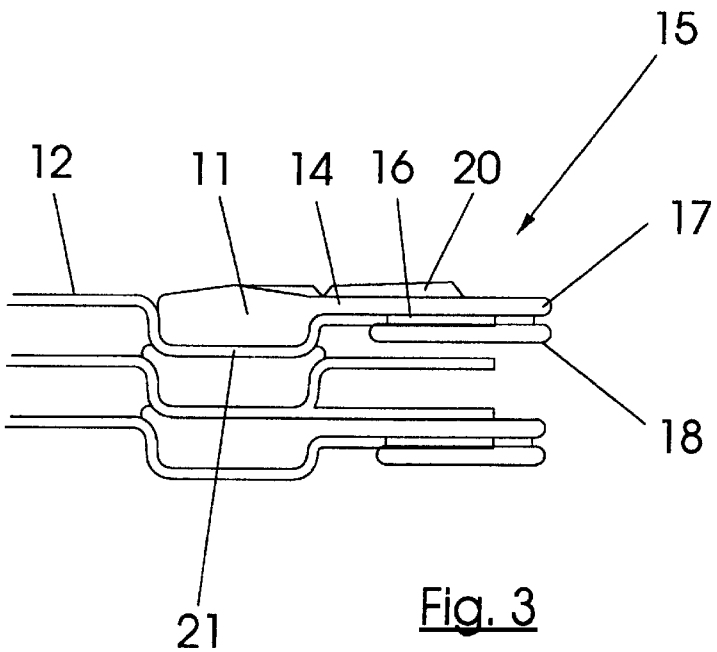
FIG. 3 shows a partially sectional view of the combination of superimposed plates of a plate-type heat exchanger according to the invention.
Figure 4:
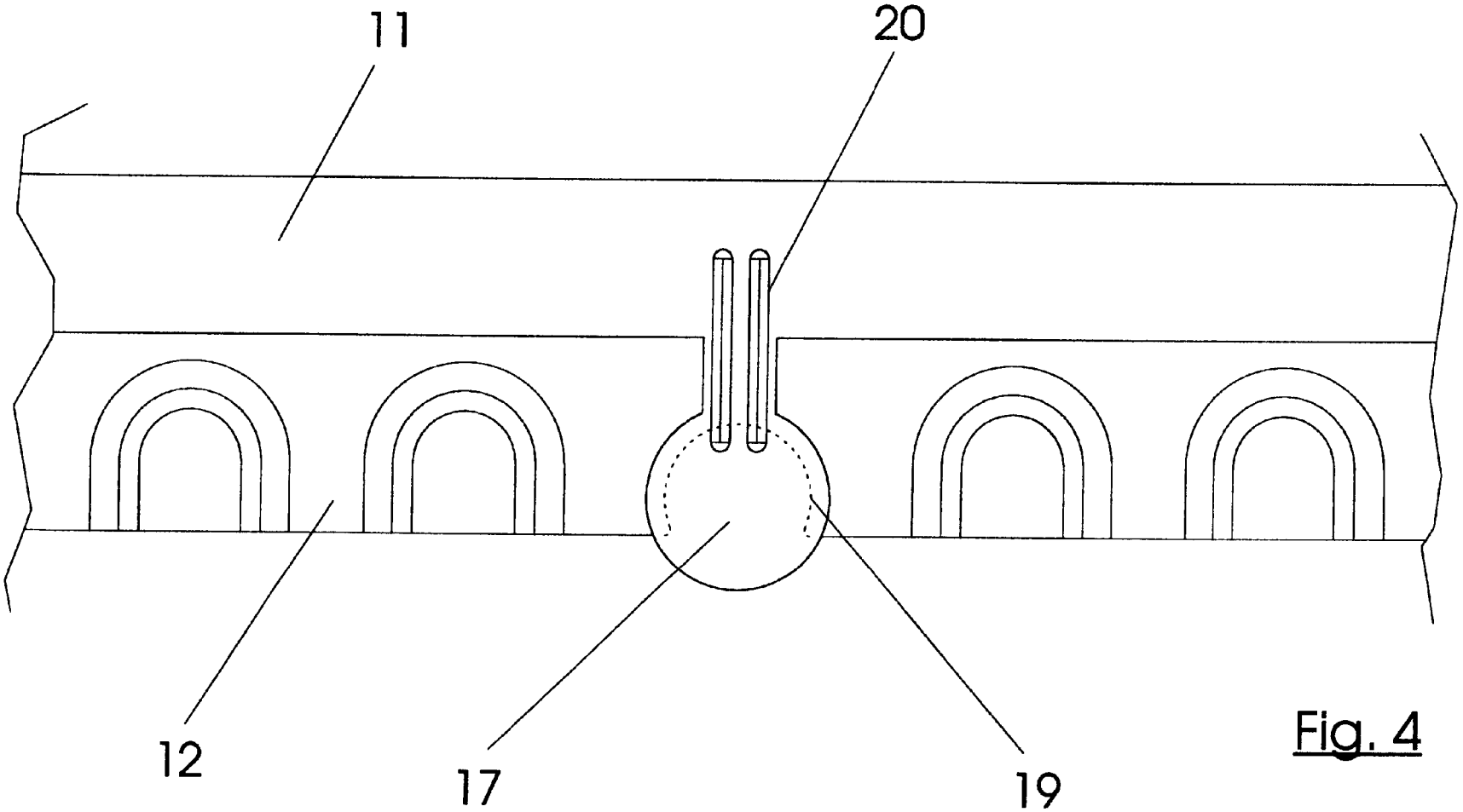
FIG. 4 shows a partially plan view of a plate provided with the sealing gasket according to the invention.

In the figure, reference sign 10 indicates a protuberance of a sealing gasket 11 used by a plate-type heat exchanger according to the present invention.

According to the present invention, sealing gasket 11, which is positioned on plate 12 of a plate-type heat exchanger, shows a plurality of protuberances 10 having a predetermined shape.

Said protuberances 10 are positioned, according to a predetermined sequence, along periphery 13 of said sealing gasket 11, i.e. in correspondence of the peripheral zone of plate 12 which said sealing gasket 11 is coupled to.

According to the form of embodiment shown in the figures, protuberances 10 comprise a first portion 14 having a substantially rectangular shape and remarkably thinner than sealing gasket 11, said first portion 14 being advantageously perpendicular to outer peripheral edge 13 of sealing gasket 11.

Besides, according to the invention, protuberance 10 comprises a second discoidally shaped portion 15 which is suitable for being coupled to sealing gasket 11 by means of first portion 14 mentioned above.

Said second portion 15 is remarkably thicker than first portion 14 and the second portion thickness is comparable to the thickness of sealing gasket 11.

Besides, within said second portion 15 is arranged a suitable groove 16, which divides second portion 15 into two identical discoidal parts 17, 18.

Said discoidal parts 17, 18 are superimposed and connected to each other by means of groove 16 which, in operation, is placed inside of a corresponding recess 19 which belongs to plate 12 with which sealing gasket 11 is coupled.

Moreover, recess 19 presents a shape which is conjugated to the shape of groove 16 in order to allow mutual coupling.

Thus, each plate 12 of the plate-type heat exchanger according to the present invention, shows a plurality of recesses 19 identical in number to protuberances 10 and positioned in correspondence of said recesses 19 along its periphery.

In such a way, when it is necessary to place sealing gasket 11 on plate 12, the skilled man settles the sealing gasket 11 inside of the seat arranged along the periphery of the plate, as previosly described with reference to the cited state of art.

Finally, he fixes sealing gasket 11 in order to couple groove 16 to the recess 19 edge of plate 12.

For this reason, recess 19 has a substantially discoidal shape and has a diameter identical to the diameter of groove 16 so as to achieve an excellent sealing even when the heat exchanger is operated at high mechanical and thermal stresses.

According to the present invention, in operation, recess 19 of plate 12 interacts with groove 16, while two discoidal parts 17, 18 of second portion 15 of sealing gasket 11 respectively interact with upper and lower surfaces of plate 12 corresponding to said recess 19.

According to a further form of embodiment of the present invention, protuberance 10 of sealing gasket 11 is provided with a suitable strengthening rib 21 present on first 14 and second 15 portions of said sealing gasket 11.

In fact, said strengthening rib 21 is longitudinally placed in respect of first portion 14 and confers rigidity and strength to first portion 14 which, as said before, is thinner than second portion 15 as well as sealing gasket 11.

The invention has previously been described with reference to some advantageous particular forms of embodiment of the same.

However, it is clear that the invention is not limited to said forms of embodiment, but it comprises several variants falling into the scope of the present invention.

For instance, it is apparent that, although the second portion of the protuberances shown in the figures has a discoidal shape, said particular shape shall not be understood as a limitation of the present invention.

Thus, according to other forms of embodiment of the present invention the second portion (and, consequently, the corresponding recess of the the heat exchanger plate) may have any other shape.

I claim:

1. A plate-type heat exchanger provided with a sealing device positioned between pairs of adjacent plates, said sealing device comprising a sealing gasket for location with a suitable peripheral groove provided on a respective plate, and a plurality of protuberances projecting from a peripheral area of said gasket towards a peripheral area of the plate with which said device is located, said protuberances being provided with a strengthening rib extending longitudinally along said protuberances, the protuberances having a rectangularly shaped first portion perpendicular to the respective plates, and a discoidally shaped second portion, said second portion being connected to the sealing gasket by said first portion, the plates being provided with a plurality of recesses having a predetermined shape and being positioned along the peripheral edge of respective plates, and the protuberances having a shape which is conjugated to the shape of the corresponding recesses so that said protuberances interact with the corresponding recesses such that an edge of respective recesses is inserted in a groove provided on the respective protuberances.

2. A plate-type heat exchanger according to claim 1, wherein said discoidally shaped second portion is divided into two discoidal parts, and whereby said groove is arranged between said discoidal parts of said second portion.

3. A plate-type heat exchanger according to claim 2, wherein said discoidal parts are substantially identical.

4. A plate-type heat exchanger provided with a sealing device positioned between pairs of adjacent plates, the plates including a plurality of recesses having a predetermined shape and position along the peripheral edge of the plates, said sealing device comprising a sealing gasket placed in a groove provided on the respective plates, a plurality of protuberances projecting from a peripheral area of said gasket towards a peripheral area of the plate in which said device is located, said protuberances having a shape for engaging the corresponding recesses so that said protuberances interact with said corresponding recesses with an edge of said recesses inserted in a groove provided on respective protuberances, the protuberances having a first portion and a second portion of predetermined shape, and a strengthening rib directed between the first portion and the second portion of the protuberances.

5. A plate-type heat exchanger according to claim 4, wherein said first portion of the sealing gasket is rectangularly shaped and is positioned substantially perpendicularly to the plate.

6. A plate-type heat exchanger according to claim 5, wherein said groove is arranged between the upper and lower surfaces of said second portion of the sealing gasket.

7. A plate-type heat exchanger according to claim 6, wherein said groove divides the second portion into two substantially identical parts.

8. A plate-type heat exchanger according to claim 4, wherein the second portion of the sealing gasket is discoidally shaped and it is connected to the peripheral area of said sealing gasket by means of said first portion.

9. A plate-type heat exchanger according to claim 8, wherein said first portion of the sealing gasket is rectangularly shaped and is positioned substantially perpendicularly to the plate.

10. A plate-type heat exchanger according to claim 4, wherein said groove is arranged between upper and lower surfaces of said second portion of the sealing gasket.

11. A plate-type heat exchanger according to claim 4, wherein said groove divides the second portion into two substantially identical parts.

12. A sealing gasket for use in a plate-type heat exchanger including pairs of adjacent plates having recesses, the sealing gasket comprising:

a plurality of protuberances projecting from a peripheral area of said gasket, the protuberances having a shape for engaging the corresponding recesses in the respective plates of the heat exchanger, the protuberances including a respective groove for location in the respective recesses;

respective portions extending from the respective protuberances to the peripheral area of the gasket; and a strengthening rib directed between the respective protuberances and the respective portions extending to the peripheral area of the gasket.

13. A gasket as claimed in claim 12, wherein the respective extending portions are directed substantially perpendicularly to the peripheral area.

14. A gasket as claimed in claim 12, wherein the protuberances include a discoidally shaped portion for connection with the portion extending to the peripheral area.

15. A gasket as claimed in claim 14, wherein the discoidally shaped portion is divided into two portions and a groove is located between the two portions.

16. A plate-type heat exchanger provided with a sealing device positioned between pairs of adjacent plates, said sealing device comprising a sealing gasket placed in a groove provided on the plates, the plates including a plurality of recesses having a predetermined shape and position along a peripheral edge of the plates, a plurality of protuberances projecting from a peripheral area of said gasket towards a peripheral area of the plate in which said device is located, said protuberances having a shape for engaging the corresponding recesses so that said protuberances interact with said corresponding recesses with an edge of said recesses inserted in a groove provided on respective protuberances, the protuberances having a first portion and a second portion of predetermined shape, and the protuberance including a discoidally shaped portion connected with the peripheral area of the sealing gasket.

17. An exchanger as previously claimed in claim 16, wherein the plate includes a peripheral groove for accommodation of the peripheral area of the sealing gasket, and wherein the groove defines a depth substantially equal to the depth of the protuberances.

* * * * *